US010094632B2

(12) United States Patent
Blakey et al.

(10) Patent No.: US 10,094,632 B2
(45) Date of Patent: Oct. 9, 2018

(54) CENTERFIRE RIFLE DETACHABLE MAGAZINE RELEASE

(71) Applicants: Mark Blakey, San Diego, CA (US); Wes Cross, San Diego, CA (US)

(72) Inventors: Mark Blakey, San Diego, CA (US); Wes Cross, San Diego, CA (US)

( * ) Notice: Subject to any disclaimer, the term of this patent is extended or adjusted under 35 U.S.C. 154(b) by 0 days.

(21) Appl. No.: 15/703,793

(22) Filed: Sep. 13, 2017

(65) Prior Publication Data

US 2018/0073827 A1 Mar. 15, 2018

Related U.S. Application Data

(63) Continuation-in-part of application No. 15/486,619, filed on Apr. 13, 2017, now Pat. No. 9,791,229.

(60) Provisional application No. 62/393,650, filed on Sep. 13, 2016.

(51) Int. Cl.

| | |
|---|---|
| ***F41A 17/38*** | (2006.01) |
| ***F41A 11/00*** | (2006.01) |
| *F41A 9/64* | (2006.01) |
| *F41A 3/66* | (2006.01) |
| *F41A 3/84* | (2006.01) |

(52) U.S. Cl.

CPC ..... *F41A 17/38* (2013.01); *F41A 11/00* (2013.01); *F41A 3/66* (2013.01); *F41A 3/84* (2013.01); *F41A 9/64* (2013.01)

(58) Field of Classification Search

CPC .. F41A 17/38; F41A 11/00; F41A 3/66; F41A 3/84; F41A 9/64

USPC ..... 42/108, 49.01, 50

See application file for complete search history.

(56) References Cited

U.S. PATENT DOCUMENTS

| | | | | |
|---|---|---|---|---|
| 2,081,235 | A * | 5/1937 | Hillyard | F41A 9/65 42/18 |
| 2,289,067 | A * | 7/1942 | Owsley | F41A 9/68 42/50 |
| 2,956,363 | A * | 10/1960 | Montana | F41A 17/38 42/18 |
| 3,415,000 | A * | 12/1968 | Koucky | F41A 17/38 42/18 |
| 4,429,479 | A * | 2/1984 | Johnson | F41A 17/38 42/6 |
| 5,636,465 | A * | 6/1997 | Johnson | F41A 9/68 42/50 |
| 7,562,482 | B1 * | 7/2009 | Johnson | F41A 9/63 42/50 |
| 9,651,328 | B1 * | 5/2017 | Oglesby | F41A 35/06 |
| 2005/0000138 | A1 * | 1/2005 | Kiss | F41A 17/36 42/50 |
| 2006/0123683 | A1 * | 6/2006 | Garrett | F41A 17/38 42/6 |
| 2011/0010977 | A1 * | 1/2011 | Cash | F41A 9/65 42/50 |
| 2013/0104440 | A1 * | 5/2013 | Addis | F41A 17/38 42/90 |
| 2014/0230297 | A1 * | 8/2014 | Larson, Jr. | F41A 17/38 42/6 |

(Continued)

*Primary Examiner* — Samir Abdosh
(74) *Attorney, Agent, or Firm* — Eric Hanscom

(57) ABSTRACT

An improved magazine catch for semi-automatic rifles containing a mechanism that requires the operator to take down the action of the rifle. The mechanism may release the magazine immediately upon taking down the action, or may require the operator to release the magazine manually.

8 Claims, 8 Drawing Sheets

(56) References Cited

U.S. PATENT DOCUMENTS

| | | | | |
|---|---|---|---|---|
| 2014/0325886 | A1* | 11/2014 | Mather | F41A 17/38 42/6 |
| 2015/0323271 | A1* | 11/2015 | McGinty | F41A 35/06 42/17 |
| 2016/0069628 | A1* | 3/2016 | Fluhr | F41A 17/38 42/6 |
| 2016/0258696 | A1* | 9/2016 | Fluhr | F41A 17/36 |
| 2017/0160026 | A1* | 6/2017 | Walther | F41A 3/66 |
| 2018/0156556 | A1* | 6/2018 | Wyssen | F41A 17/38 |

* cited by examiner

DETAIL H

SECTION B-B

SECTION C-C

CENTERFIRE RIFLE DETACHABLE MAGAZINE RELEASE

CROSS REFERENCE TO RELATED APPLICATIONS

This application claims priority from U.S. Provisional Application No. 62/393,650, filed Sep. 13, 2016 and from U.S. Utility patent application Ser. No. 15/486,619, filed Apr. 13, 2017.

STATEMENT REGARDING FEDERALLY SPONSORED RESEARCH OR DEVELOPMENT

This invention was not federally sponsored.

BACKGROUND OF THE INVENTION

Field of the Invention

This application relates to semi-automatic firearms and more specifically the attachment of the ammunition feeding device.

Background—Prior Art

The present invention relates to systems and methods for efficiently releasing detachable magazines from firearms. Different types of firearms and firearm accessories have increased steadily over time in both functionality and flexibility, and today there is a wide variety of firearm modifications and/or accessories available. Innovation in the firearms industry is also driven by legislative trends, as firearm owners are required to respond by limiting the functionality of their firearms and/or accessories.

In recent times, Federal and/or State laws have limited features of semi-automatic firearms and/or also the capacity of firearm magazines. For example, in some jurisdictions, the use of detachable magazines with semi-automatic rifles is strictly regulated. Parts of the firearm common to someone in the art will only be given a brief description as necessary. A detachable magazine refers to an ammunition feeding device that can be removed from the firearm, reloaded and replaced. A common semi-automatic rifle is comprised of an upper and lower receiver.

These two parts together are commonly known as the action of the firearm. The lower receiver most commonly houses the magazine well and the fire control group. The fire control group is comprised of, at the very least, a trigger and a hammer. The upper receiver most commonly houses the bolt and the firing pin. The method of removing the magazine from the magazine well has been approached by different methods. With current laws and safety concerns, these methods fall short of a solution. Some current solutions to this problem require the use of a tool to remove the magazine, as in US patent 20130227869 to Alan T. Thordsen 2013 Sep. 5, but this does not address the issue of the action of the firearm needing to be taken down. The device in U.S. Pat. No. 8,756,845 to Courtney Harris 2014 Jun. 24 does address the issue of the action, but is done so using a difficult and cumbersome approach. The present embodiment solves the removal of the magazine in the safest and easiest fashion.

SUMMARY

In accordance to one embodiment, a catch holds a magazine in place until one wishes to remove it, only after opening the action of the firearm.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

One preferred form of the invention will now be described with reference to the accompanying drawings.

DETAILED DESCRIPTION OF THE FIGURES

Figure 1:
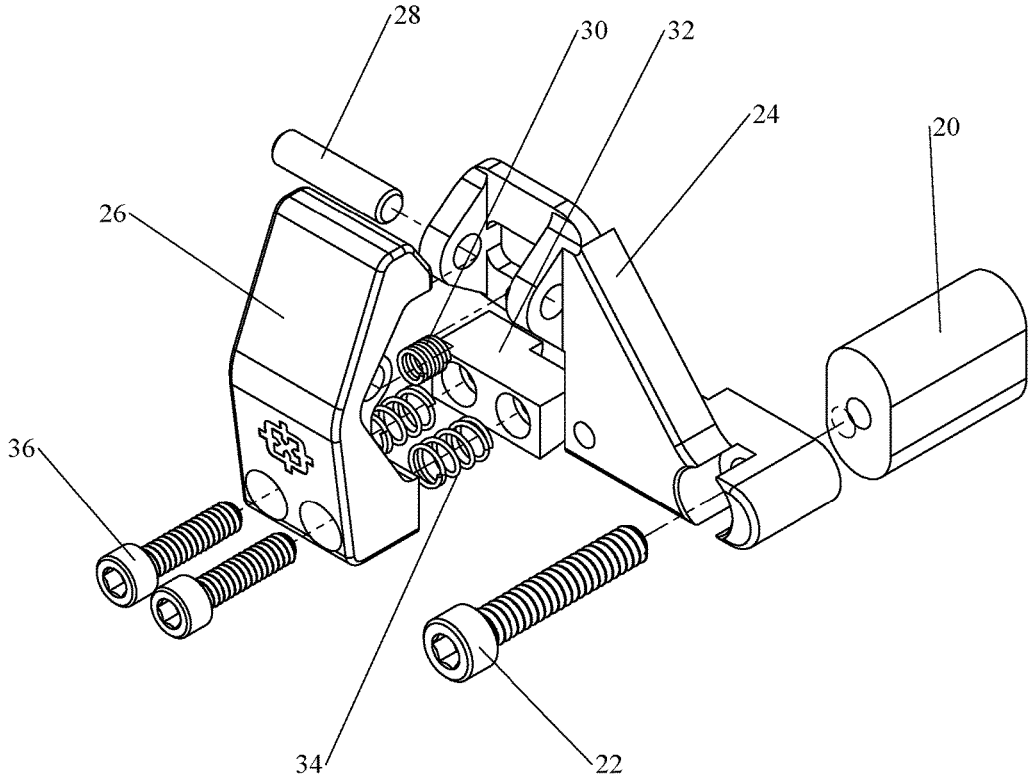
FIG. 1 shows an exploded view of one embodiment.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

Detailed Description—First Embodiment

The present invention will now be described in detail with reference to the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have no detailed description in order to not unnecessarily obscure the present invention. The features and advantages of embodiments may be better understood with reference to the drawings and discussions that follow.

FIG. 1 shows an exploded view of one embodiment of the invention. An oval nut 20 is attached to the main body 24 with main screw 22. A hinge body 26, is attached to the main body 24 via a hinge pin 28. Hinge spring 30 is installed between hinge body 26 and main body 24. Catch screws 36 are loosely fit through hinge body 26 and into catch 32. Catch springs 34 are placed between catch 32 and hinge body 26 over the catch screws 36. Parts of the embodiment main body 24, oval nut 20, hinge body 26 and catch 32 are made from aluminum but could be made from any material suitable. Parts main screw 22 and catch screw 36 refer to a means of fastening parts together. In this embodiment, main screw 22 and catch screw 36 are screws but could also be press pins or any other method of attaching two parts.

Figure 2:
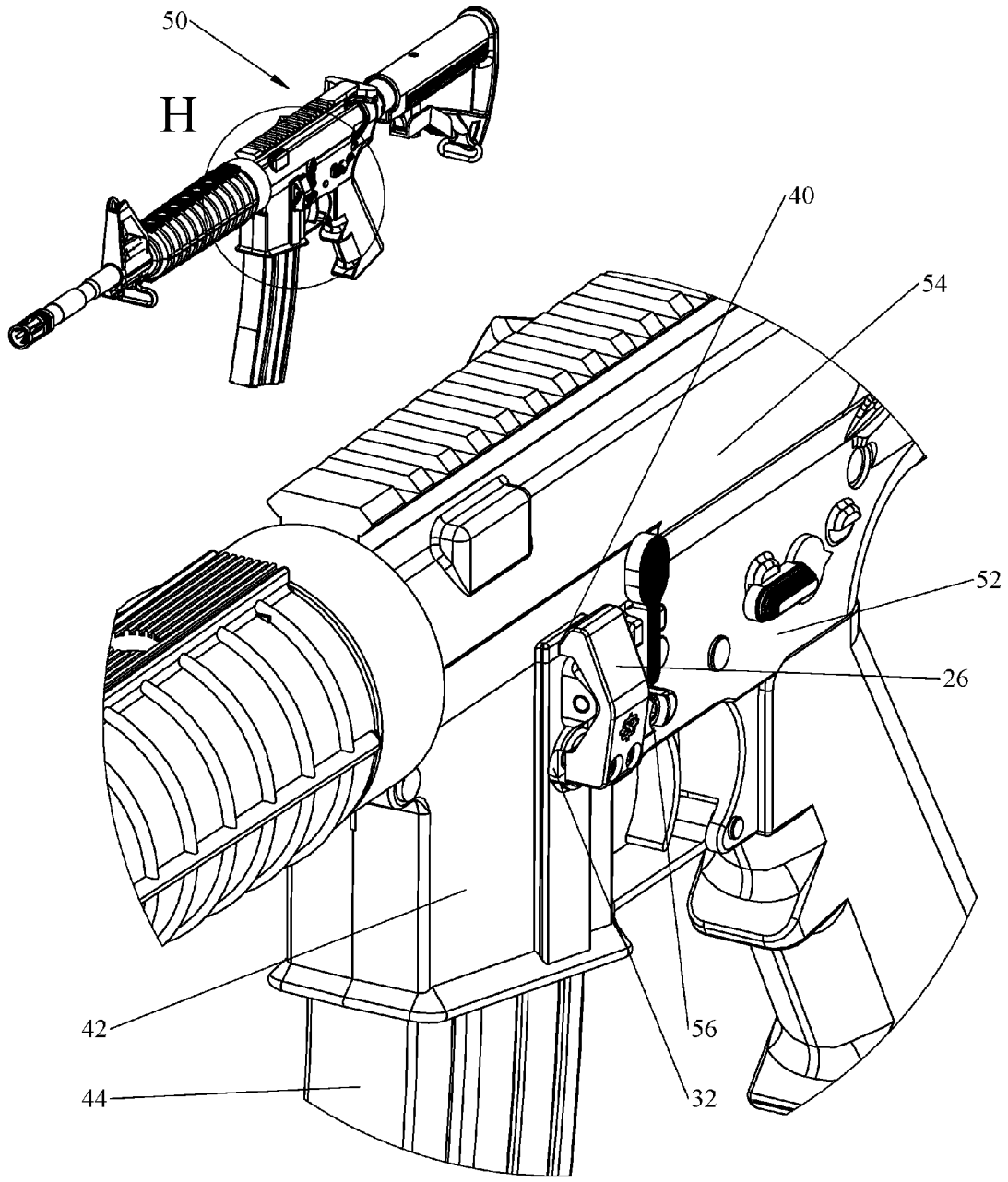
FIG. 2 shows the embodiment installed on a semi-automatic rifle in the closed state.

FIG. 2 shows the embodiment installed on the firearm 50. Detail H shows the embodiment installed into catch bar slot 56 of lower receiver 52 with lower receiver 52 and upper receiver 54 attached together in the closed position. Tip 40 of hinge body 26 rests against the side of the upper receiver 54. The catch 32 rests inside magazine well 42 against magazine 44.

Figure 3:
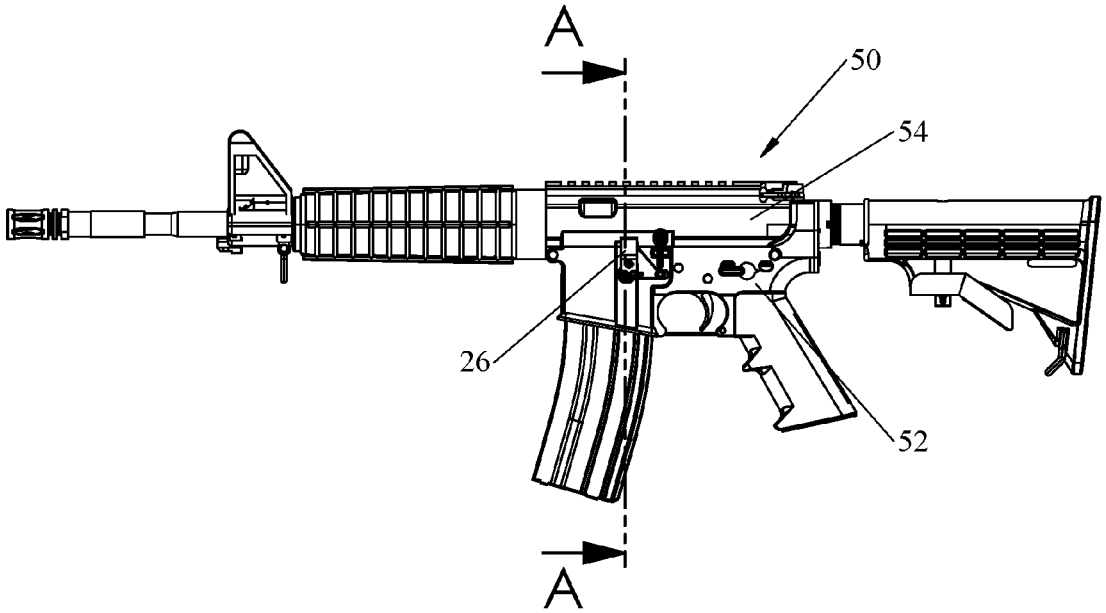
FIG. 3 shows the firearm in the closed state with section line A-A.

FIG. 3 shows the embodiment installed on firearm 50. The upper receiver 54 and lower receiver 52 are in a closed state with section line A-A dissecting the firearm and centerline of hinge body 26 of the embodiment.

Figure 4:
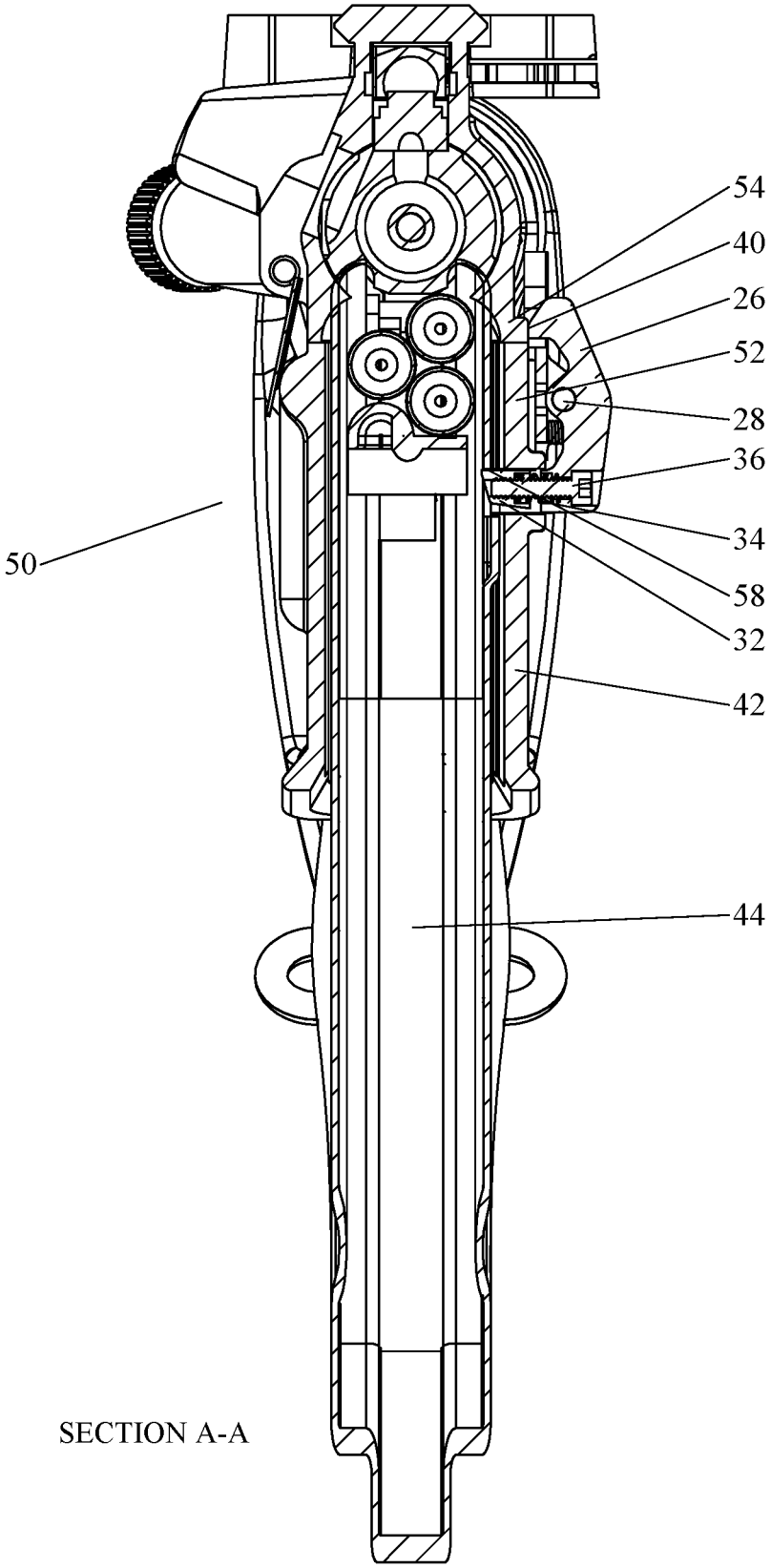
FIG. 4 shows the detail of section view A-A.

FIG. 4 shows section view A-A. The embodiment is installed on a firearm 50 into lower receiver 52 with the lower receiver 52 and the upper receiver 54 in a closed state. Tip 40 of hinge body 26 rests against the side of the upper receiver 54. The catch 32 rests inside magazine well 42 inside magazine slot 58.

Figure 5:
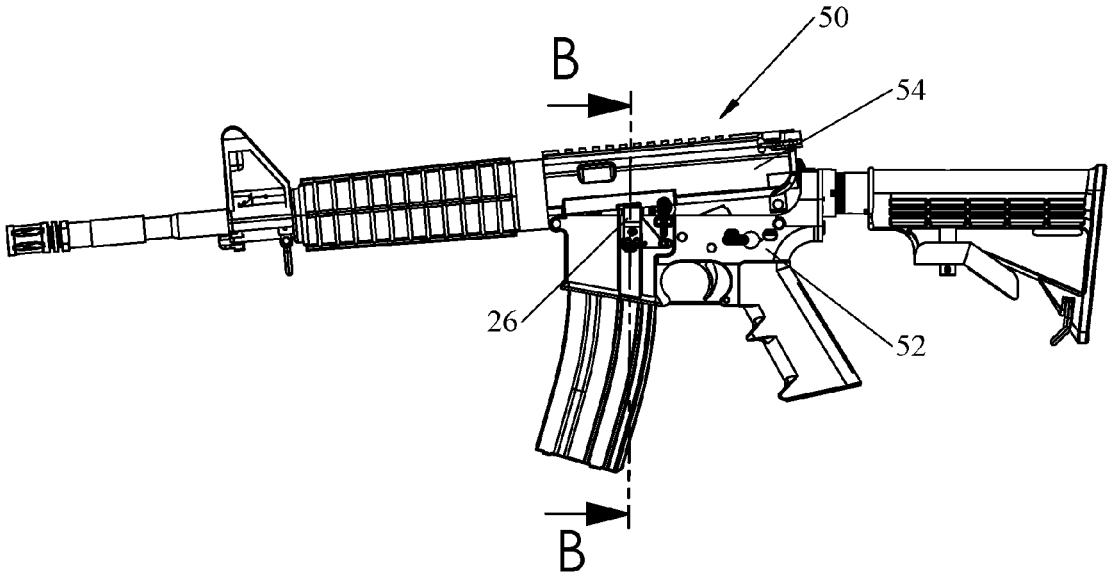
FIG. 5 shows the firearm in the open state with section line B-B.

FIG. 5 shows the embodiment installed on firearm 50. The upper receiver 54 and lower receiver 52 are in an opened state with section line B-B dissecting the firearm and centelive of hinge body 26 of the embodiment.

Figure 6:
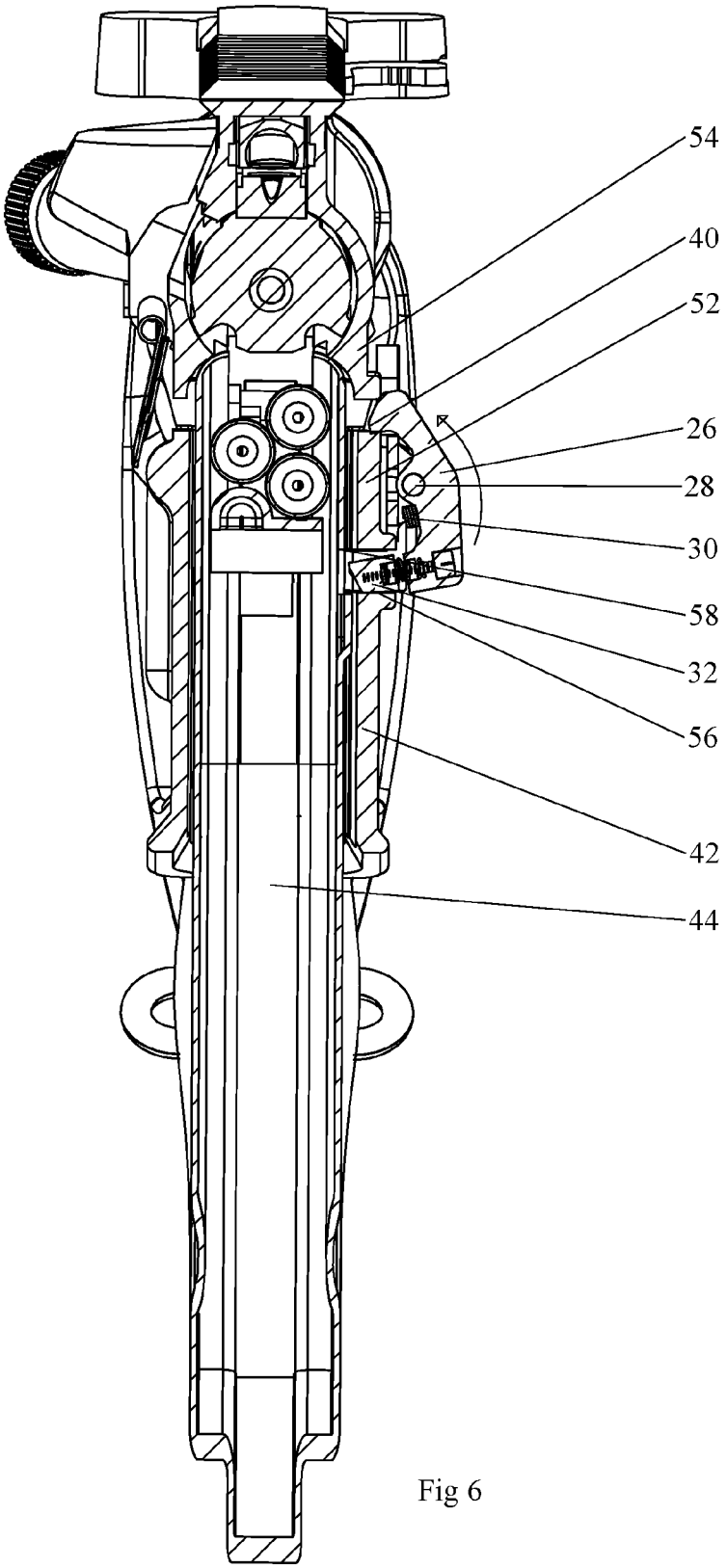
FIG. 6 shows the detail of section view B-B.

FIG. 6 shows section view B-B. The embodiment is installed on a firearm 50 into lower receiver 52 with the lower receiver 52 and the upper receiver 54 in an opened state. Tip 40 of hinge body 26 does not contact upper receiver 54. Hinge 26 is pivoted about hinge pin 28. Catch 32 is not in contact with magazine slot 58. Catch 32 is slightly inside catch bar slot 56.

Figure 7:
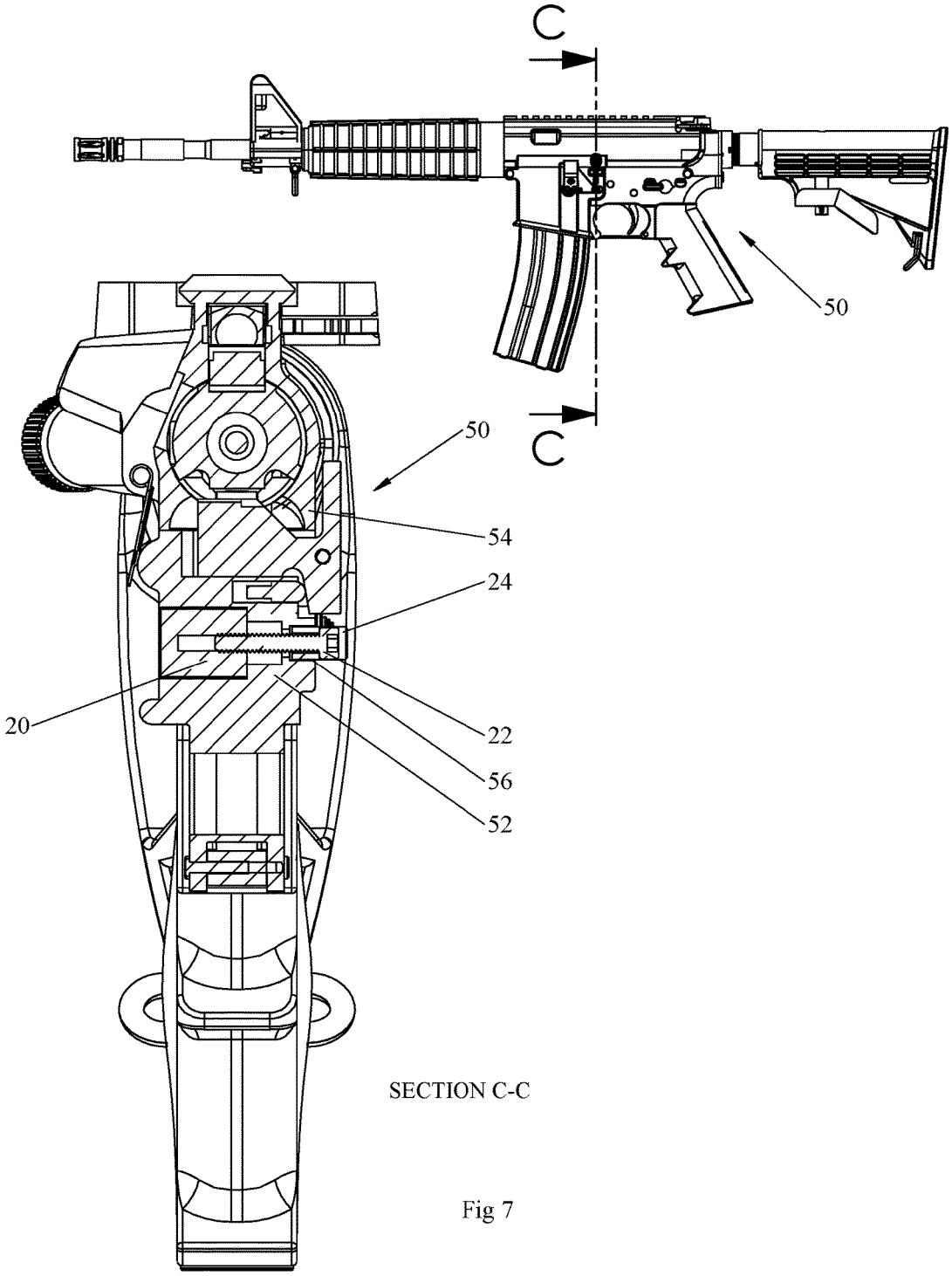
FIG. 7 shows the embodiment installed and a detailed view section view C-C.

FIG. 7 shows the embodiment installed on firearm 50. The upper receiver 54 and lower receiver 52 are in a closed state with section line C-C dissecting the firearm and centerline of oval nut 20 of the embodiment. Detail section view C-C shows the oval nut inserted into the opposite side of the lower receiver 52 from main body 24. Main screw 22 passes through main body 24 and lower receiver 52 and into oval nut 20.

Operation—First Embodiment

The first embodiment operation will be described so that one familiar with the art can assemble and use. Description of parts of the firearm known to those in the art will be omitted unless necessary. Well known process steps and/or structures have been simplified in order to not unnecessarily obscure the present invention.

As in FIG. 1, hinge body 26 is attached to main body 24 with hinge spring 30 between hinge body 26 and main body 24, and secured with hinge pin 28. Hinge pin 28 shall be tight to main body 24 so as to not fall out, but loose fit to hinge body 26 to allow hinge body 26 to pivot freely. Catch screw 36 is inserted through hinge body 26. Catch spring 34 can now be placed over catch screw 36 and catch screw 36 can be threaded into catch 32.

As in FIG. 7, the embodiment is to be installed onto a lower receiver 52 of firearm 50 using mains screw 22 and oval nut 20. The embodiment is placed into catch bar slot 56 and and main screw 22 is put through main body 24 and lower receiver 52 and threaded into oval nut 20.

As in FIG. 4, the tip 40 of hinge body 26 rests against upper receiver 54, pivoting the hinge body 26 so that catch 32 is in magazine well 42. When a magazine 44 is installed into magazine well 42, catch 32 moves, depressing catch spring 34 until the magazine 44 is fully installed and the catch locks into the magazine slot 58. Catch screw 36 can be adjusted in or out to allow catch 26 to fully engage magazine catch 58.

As in FIG. 5-6, when the upper receiver 54 is opened away from lower receiver 52 the tip 40 of the hinge body 26 can no longer contact the upper receiver 54. The hinge spring 30 applies pressure to the hinge body 26, causing it to pivot about hinge pin 28. When the hinge body 26 is in this pivoted state, the catch 32 is removed from magazine slot 58 allowing the magazine 44 to be removed from the magazine well 42.

Upon closing the upper receiver 54 to lower receiver 52, the slope leading to tip 40 of hinge body 26 will come in contact with the upper receiver 54, pivoting hinge body 26 and returning the catch 32 to the magazine well 42.

Detailed Description—Second Embodiment

Figure 8:
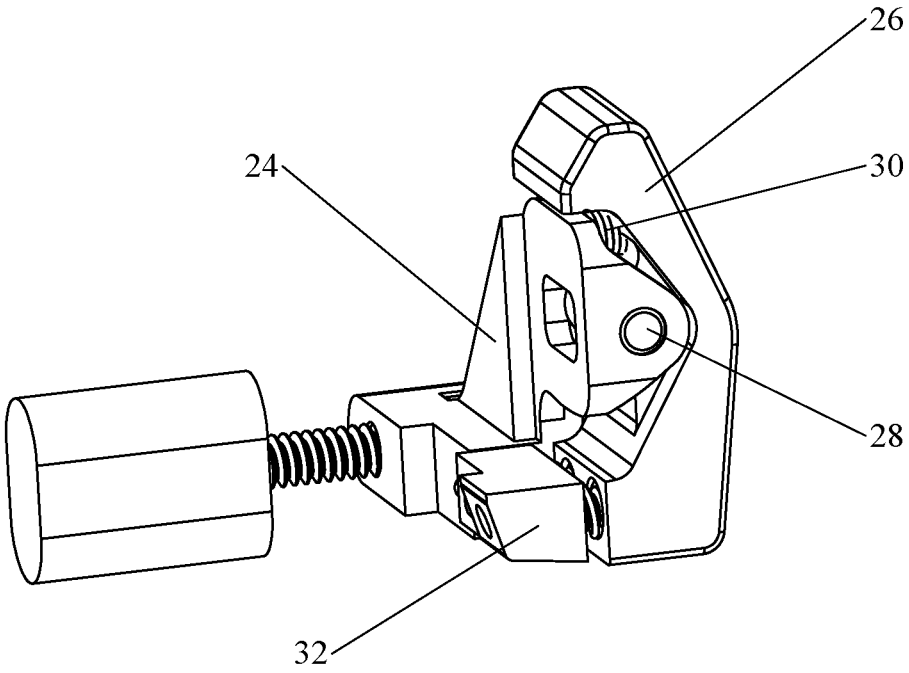
FIG. 8 shows an alternate embodiment.

FIG. 8 shows an alternate embodiment of the invention with hinge spring 30 located on the opposite side of hinge pin 28 from catch 32 between main body 24 and hinge body 26.

Operation—Second Embodiment

This embodiment has the hinge spring 30 located above the hinge pin 28. Hinge spring 30 continuously applies pressure on hinge body 26, keeping catch 32 located in the magazine well 42. When upper receiver 54 is in the open state, the operator can press on hinge body 26 to overcome hinge spring 30, pivoting hinge body 26, causing catch 32 to move out of magazine slot 58.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

DRAWINGS-REFERENCE NUMERALS

20 Oval nut
22 Main screw

-continued

| DRAWINGS-REFERENCE NUMERALS |
|---|
| 24 Main body |
| 26 Hinge body |
| 28 Hinge pin |
| 30 Hinge spring |
| 32 Catch |
| 34 Catch spring |
| 36 Catch screw |
| 40 Tip |
| 42 Magazine well |
| 44 Magazine |
| 50 Firearm as a whole |
| 52 Lower receiver |
| 54 Upper receiver |
| 56 Catch bar slot |
| 58 Magazine slot |

We claim:

1. A detachable magazine release assembly for effectively releasing detachable magazines from firearms, comprising:

a hinge pin main body;

a hinge body, a hinge spring, a hinge pin, with a tip, two catch springs, two catch screws, a main screw, and an oval nut;

where, the hinge pin connects the hinge body to the hinge pin main body, where, the hinge body additionally comprises two holes, through which the two catch screws can be inserted, and where the hinge pin main body has two screw holes into which the two catch screws can be inserted, where the two catch screws have a head and a threaded section, where the threated section has an outer diameter, and where the two catch springs have in inner diameter, and where the inner diameter is larger than the outer diameter of the threaded section of the two catch screws, where the hinge spring rests in between the hinge pin main body and the hinge body, and where the hinge spring provides an outward force between the hinge pin main body and the hinge body, and is removably attached to the hinge pin main body, where the hinge spring main body additionally comprises a hinge pin main body hole, into which a main screw can be inserted, where the main screw has external threads that mate with several internal threads in an oval nut, where the detachable magazine release assembly is inserted into a catch bar slot in a firearm, an upper half and a lower half of the firearm is secured in a releasable pivotal assembly by the detachable magazine release assembly, where, a tip of the hinge body protrudes through the catch bar slot and rests against an indentation in a magazine, and when the upper receiver is pivotally rotated away from the lower receiver, the hinge body is forcibly pushed back and the tip of the hinge body is no longer in contact with the upper receiver, thereby detaching the magazine.

2. A detachable magazine release assembly for effectively releasing detachable magazines from firearms, comprising:

a hinge pin main body;

a hinge body, a hinge spring, a hinge pin, with a tip, two catch springs two catch screws a main screw and an oval nut;

where, the hinge pin connects the hinge body to the hinge pin main body, where, a tip of the hinge body protrudes through the catch bar slot and rests against an indentation in a magazine, and when the upper receiver is pivotally rotated away from the lower receiver, the hinge body is forcibly pushed back and the tip of the hinge body is no longer in contact with the upper receiver, thereby detaching the magazine.

3. The detachable magazine release assembly of claim 2, where, the hinge body additionally comprises two holes, through which the two catch screws can be inserted, and where the hinge pin main body has two screw holes into which the two catch screws can be inserted, where the two catch screws have a head and a threaded section, where the threated section has an outer diameter, and where the two catch springs have in inner diameter, and where the inner diameter is larger than the outer diameter of the threaded section of the two catch screws.

4. The detachable magazine release assembly of claim 3, where the hinge spring rests in between the hinge pin main body and the hinge body, and where the hinge spring provides an outward force between the hinge pin main body and the hinge body.

5. The detachable magazine release assembly of claim 4, where the hinge spring is removably attached to the hinge pin main body.

6. The detachable magazine release assembly of claim 5, where the hinge spring main body additionally comprises a hinge pin main body hole, into which a main screw can be inserted, where the main screw has external threads that mate with several internal threads in an oval nut.

7. The detachable magazine release assembly, of claim 6 where the detachable magazine release assembly is inserted into a catch bar slot in a firearm.

8. The detachable magazine release assembly of claim 7, where an upper half and a lower half of the firearm is secured in a releasable pivotal assembly by the detachable magazine release assembly, where, a tip of the hinge body protrudes through the catch bar slot and rests against an indentation in a magazine, and when the upper receiver is pivotally rotated away from the lower receiver, the hinge body is forcibly pushed back and the tip of the hinge body is no longer in contact with the upper receiver, thereby detaching the magazine.

* * * * *